United States Patent [19]

Rampel

[11] 4,090,329

[45] May 23, 1978

[54] WINDOW OPERATING MECHANISM

[75] Inventor: Hans Rampel, Eicha, Germany

[73] Assignee: Metallwerk Max Brose GmbH & Co., Coburg, Germany

[21] Appl. No.: 829,622

[22] Filed: Sep. 1, 1977

[30] Foreign Application Priority Data

Sep. 30, 1976 Germany ..... 2644213

[51] Int. Cl.[2] ..... E05F 11/48

[52] U.S. Cl. ..... 49/352; 49/360

[58] Field of Search ..... 49/352, 360, 349, 227, 49/375

[56] References Cited

U.S. PATENT DOCUMENTS

| | | | |
|---|---|---|---|
| 3,427,748 | 2/1969 | Marr | 49/352 |
| 3,444,649 | 5/1969 | Rivolier | 49/352 |
| 3,681,874 | 8/1972 | Golde et al. | 49/352 |
| 4,004,371 | 1/1977 | Podolan et al. | 49/352 |

*Primary Examiner*—Philip C. Kannan
*Attorney, Agent, or Firm*—Hans Berman

[57] ABSTRACT

The window operating mechanism in a motorcar door includes a window support moved by a bowden cable extending in an angular loop. The wire of the cable is protected in the corners of the loop by a flexible sheath deflected into an arc by a rigid U-channel having an open convex side and held in the groove of the channel by annular end pieces. An adjacent straight portion of the wire is fastened to the window support in a slot of a tubular guide having one end received in a blind groove of one of the end pieces.

10 Claims, 6 Drawing Figures

Fig. 6
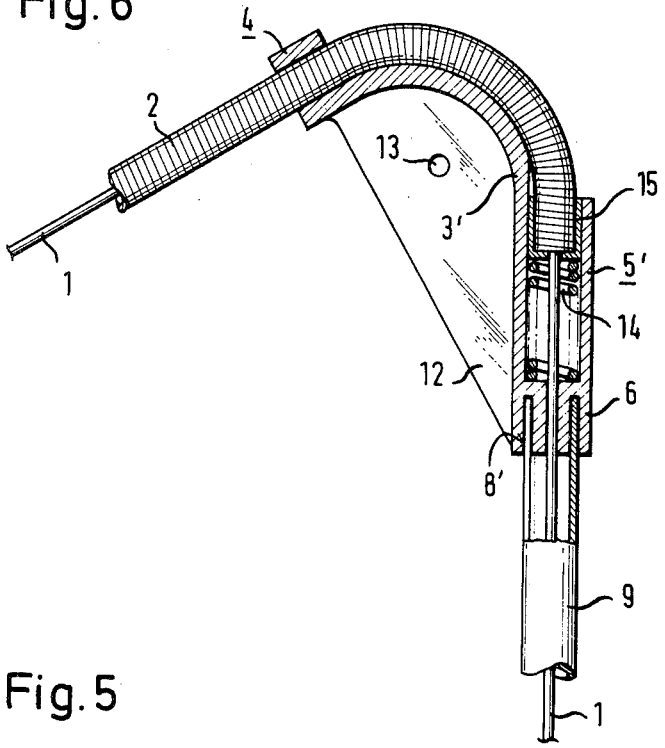
Fig. 5
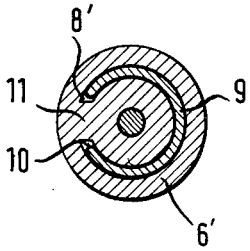
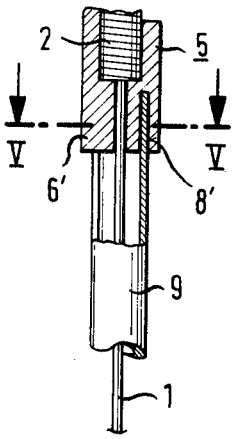
Fig. 4

WINDOW OPERATING MECHANISM

This invention relates to operating mechanisms for windows which may be opened and closed by sliding movement in a frame, such as windows on the body of a motor vehicle, and particularly to an improved window operating mechanism in which motion is transmitted from a manual drive or a drive motor to the window by an elongated tension member, such as a wire or cable.

In its more specific aspects, the invention is concerned with improvements in a window operating mechanism of the type disclosed in U.S. Pat. No. 3,444,649 in which a window is raised and lowered by means of a driven cable extending in an angular loop and guided in rigid tubes. The portion of the known mechanism which this invention aims at improving is shown in FIGS. 5 and 6 of the Patent.

While the known device has been used successfully, it has been found that its useful life is limited by fraying and ultimate failure of the motion transmitting cable due to friction at the rounded corners of the angular loop. It is the primary object of this invention to protect the cable of an otherwise similar mechanism against premature frictional wear.

With this object and others in view, as will hereinafter become apparent, the mechanism of the invention includes an elongated tube formed with a longitudinal slot which communicates with the bore of the tube. The support assembly for the window to be operated is slidably guided on the tube, and a portion of the assembly is received in the slot of the latter. An elongated tension member is partly received in the tube bore and fastened there to the support assembly. Another part of the tension member which projects from the bore of the tube is deflected into an arcuate path by a unitary deflector having an elongated channel portion extending in an arc and formed with a longitudinal groove, and two longitudinally terminal, annular portions connected by the channel portion. The terminal portions each extend in a closed loop about an opening which communicates with the groove in the channel portion. A recess extends about the opening in one of the terminal deflector portions and receives one longitudinal end of the tube. Portions of a tubular sheath are received in the groove and the two openings of the deflector. The tension member extends from the fastened part of the support assembly in the bore of the guide tube through the sheath beyond the other terminal portion of the deflector. The tension member may be moved longitudinally for thereby moving the window support.

Other features, additional objects, and many of the attendant advantages of this invention will readily be appreciated as the same becomes better understood from the following detailed description of preferred embodiments when considered in connection with the appended drawing in which:

FIG. 4 shows a modified portion of the mechanism of FIG. 1;

FIG. 5 is a sectional view of the device of FIG. 4 taken of the line V — V; and

Figure 1:
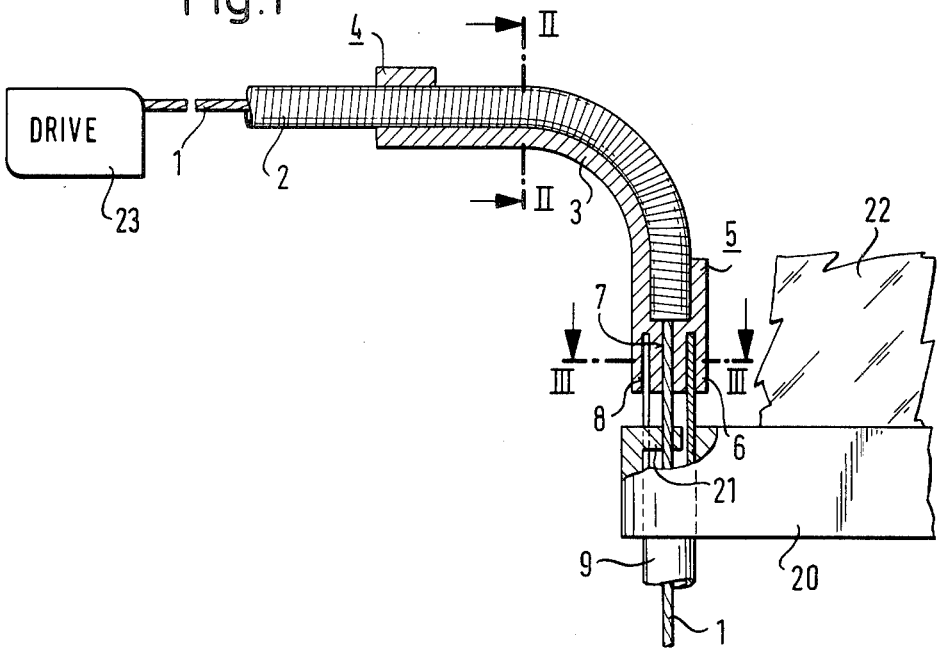
FIG. 1 shows a window operating mechanism of the invention in fragmentary elevation and partly in section.

FIG. 6 shows a partial modification of the mechanism of FIG. 1 in a corresponding view. De Referring now to the drawing in detail, and initially to FIG. 1, there is shown only as much of a window lifting mechanism of the afore-mentioned, known type as is necessary for an understanding of the invention. More specifically, only a corner portion of the path of a motion transmitting tension member 1, in this embodiment a steel wire, and associated elements are shown, the remainder of the path including corner portions analogous to the one illustrated.

Figure 3:
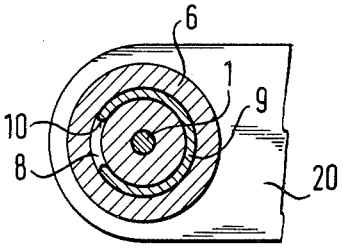
FIG. 3 illustrates the device of FIG. 1 in fragmentary, enlarged section on the line III — III.

In a curved portion of its path and beyond the same to a drive mechanism 23, the wire 1 is slidably received in a tubular sheath 2 formed of a spirally would wire, as is conventional in bowden cables. The drive mechanism, which may be of the type shown in FIG. 3 of the aforementioned patent, has not been illustrated in detail. It permits the wire to be pulled longitudinally through the sheath 2 while the sheath is stressed in longitudinal compression.

Figure 2:
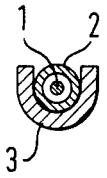
FIG. 2 shows the device of FIG. 1 in section on the line II — II.

The arcuate portion of the sheath 2 is backed by a deflector mainly consisting of a U-channel 3 bent into an arc, the open side of the channel being convex, as is seen in FIG. 2, and two terminal sleeves 4, 5 which each extend in a closed loop about an opening communicating with the groove of the channel 3 and receiving respective portions of the sheath 2. One end of the sheath extends from the sleeve 4 to the drive 23, as is not specifically shown, and the other end terminates at a shoulder in the opening of the deflector sleeve 5 formed by the thicker wall of a sleeve portion 6 remote from the channel 3. Only the wire 1 passes through the reduced part 7 of the opening in the portion 6.

A blind annular recess 8 in the sleeve portion 6 coaxially extends about the opening part 7 inward from the free radial end face of the sleeve 5, but is sealed toward the groove in the channel 3 by an integral wall of the sleeve portion 6. One end of a straight guide tube 9 formed with a slot 10 over its entire length is received in the recess 8. The tube 9 is slidably received in a bore of a bracket 20 and guides vertical movement of the bracket. Two integral clamping prongs 21 project from the annular part of the bracket 20 enveloping the tube 9 and through the slot 10 into the bore of the tube where they are fixedly attached to the wire 1. The bracket 20 is an element of a support assembly for a window 22, not otherwise shown, but known from the cited patent.

The window 22 is raised when the wire 1 is pulled by the drive 23 through the groove of the illustrated deflector channel 3. When the drive is operated in the opposite direction, it pulls the wire 1 downward in the guide tube 9 in a known manner, not specifically illustrated, and the window 22 is lowered.

The tube 9 is prevented from turning about its longitudinal axis only by frictional engagement with the sleeve part 6 in the recess 8 of the first-described embodiment of the invention. Turning of the tube is prevented more safely in the modified mechanism partly shown in FIGS. 4 and 5, and identical with that described with reference to FIGS. 1 and 3 as far as not set forth specifically. The end part 6′ of the sleeve 5 has a blind recess 8′ which is approximately C-shaped in cross section and thereby corresponds to the similar cross section of the tube 9. The two ends of the C-shaped in the recess 8′ are separated by an integral locking wall 11 of the sleeve part 6′ whose circumferential width is only slightly smaller than the corresponding dimension of the slot 10.

The deflector 3, 4, 5 illustrated in FIGS. 1 to 5 is a unitary piece of material such as zinc diecasting alloy or plastic much more rigid under flexing stress than the sheath 2. If a very heavy window is to be operated by means of the wire 1, the flexural rigidity of the deflector may be further increased by a web or rib 12 cast or molded as a unitary part of the deflector 3', 4, 5' illustrated in FIG. 6. The web 12 extends over the entire concave, longitudinal face of the channel 3' and over adjacent face portions of the sleeves 4, 5'. A hole 13 in the web normally receives a screw, not shown, which fastens the entire mechanism to the stationary frame of the window omitted from the showing of FIG. 6.

The wide bore portion of the sleeve 5' is dimensioned to receive a cup-shaped receptacle 15 with a sliding fit. The illustrated end of the sheath 2 is received in the receptacle 15 and held under compressive stress by a helical compression spring 14 interposed between the bottom of the receptacle 15 and the internal shoulder of the thick-walled sleeve portion 6. The wire 1 passes freely through an opening in the bottom of the receptacle and axially through the spring 14.

In all illustrated embodiments of the invention, the wire 1 is precisely guided into the end of the sheath 2 in the sleeve 5 and held safely away from the tube 9. It is exposed to only minimal friction as it enters the sheath and moves through the same. Similar protection is provided at the other corners of the closed loop in which the wire is moved by the drive 23 in a manner obvious from the illustrated structure and not specifically shown.

Because of the flexibility of the sheath 2, the window operating mechanism of the invention is relatively simple to install in the door of a motorcar and is not interfered with by other door elements which would complicate the installation of rigid, tubular sheaths for the wire.

The spring 14 and the rib 12 shown in FIG. 6 by way of example may be combined individually with other features of the mechanism illustrated in FIG. 1. The spring not only compresses the sheath 2, but also tensions the wire 1 and permits the elimination of other tensioning devices requiring more of the scarce space in the interior of a motorcar door. The receptacle 15 slides in the sleeve 5' with less friction than would the sheath 2.

It should be understood, of course, that the foregoing disclosure relates only to preferred embodiments of the invention, and that it is intended to cover all changes and modifications of the examples of the invention here chosen for the purpose of the disclosure which do not constitute departures from the spirit and scope of the invention set forth in the appended claims.

What is claimed is:

1. A window operating mechanism comprising:

(a) an elongated tubular guide member defining a longitudinal bore therein and formed with a longitudinal slot communicating with said bore;

(b) a support assembly slidably guided on said guide member, a portion of said assembly being received in said slot, said assembly including means for supporting the window to be operated;

(c) an elongated tension member partly received in said bore and fastened to said portion of said support assembly, a part of said tension member projecting longitudinally from said bore;

(d) deflector means for deflecting said projecting part into an arcuate path, (1) said deflector means including an elongated channel portion extending in an arc and formed with a longitudinal groove, and two longitudinally terminal, annular portions connected by said channel portion, (2) said terminal portions each extending in a closed loop about an opening communicating with said groove, (3) one of said terminal portions being formed with a recess extending about the opening thereof and receiving one longitudinal end of said guide member;

(e) a tubular sheath having respective portions received in said groove and in the openings of said terminal portions, (1) said tension member extending from said portion of said support assembly through said sheath beyond the other terminal portion of said deflector means; and (f) drive means for longitudinally moving said tension member and for thereby moving said support assembly.

2. A mechanism as set forth in claim 1, wherein said channel portion has a concave longitudinal face and a convex longitudinal face, and is formed with an elongated opening in said convex face extending substantially from said one terminal portion to said other terminal portion.

3. A mechanism as set forth in claim 2, wherein said one terminal portion is formed with an annular shoulder in the opening thereof, said sheath engaging said shoulder in longitudinally abutting engagement.

4. A mechanism as set forth in claim 2, further comprising a reinforcing rib fixedly fastened to said concave face.

5. A mechanism as set forth in claim 4, further comprising fastening means on said rib for fastening said deflector to a window frame.

6. A mechanism as set forth in claim 4, wherein said rib, said channel portion, and said terminal portions jointly constitute a unitary piece of material, said bore in said guide member is straight, and said sheath is more flexible than said unitary piece of material.

7. A mechanism as set forth in claim 1, wherein said one terminal portion includes a wall sealing said recess toward said groove.

8. A mechanism as set forth in claim 7, wherein said one terminal portion further includes a locking part in said recess, said locking part being received in said slot of the guide member and preventing rotation of the guide member about a longitudinal axis.

9. A mechanism as set forth in claim 1, wherein said one terminal portion is formed with an annular shoulder in the opening thereof, said mechanism further comprising a compression spring interposed between said shoulder and said sheath.

10. A mechanism as set forth in claim 9, further comprising receptacle on said spring movable in said opening of the one terminal portion, said sheath being received in said receptacle.

* * * * *